US007148182B2

(12) United States Patent
Field et al.

(10) Patent No.: US 7,148,182 B2
(45) Date of Patent: Dec. 12, 2006

(54) MULTILAYERED COLOR COMPOSITIONS AND ASSOCIATED METHODS

(75) Inventors: Marshall Field, Corvallis, OR (US); David P. Markel, Albany, OR (US); Sandra L. Hill, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 239 days.

(21) Appl. No.: 10/833,789

(22) Filed: Apr. 27, 2004

(65) Prior Publication Data

US 2005/0239650 A1 Oct. 27, 2005

(51) Int. Cl.
*B41M 5/30* (2006.01)

(52) U.S. Cl. ..... 503/201; 503/206; 428/64.4; 430/200

(58) Field of Classification Search ..... 500/200–226; 428/64.4; 430/200; 503/201, 206
See application file for complete search history.

(56) References Cited

U.S. PATENT DOCUMENTS

| | | | | |
|---|---|---|---|---|
| 3,658,543 | A | 4/1972 | Gerlach, Jr. et al. | |
| 4,554,565 | A * | 11/1985 | Kito et al. | 503/201 |
| 5,100,711 | A | 3/1992 | Satake et al. | |
| 5,202,304 | A | 4/1993 | Iwakura et al. | |
| 5,462,909 | A | 10/1995 | Lakes et al. | |
| 5,555,800 | A | 9/1996 | Rice | |
| 5,595,955 | A * | 1/1997 | Chang et al. | 503/201 |
| 5,680,222 | A | 10/1997 | Ashworth | |
| 5,797,632 | A | 8/1998 | Rice | |
| 5,885,926 | A | 3/1999 | Matsumoto | |
| 5,919,928 | A | 7/1999 | Ohashi et al. | |
| 6,028,029 | A | 2/2000 | Takeuchi | |
| 6,060,428 | A * | 5/2000 | Chang et al. | 503/201 |
| 6,072,592 | A | 6/2000 | Ashworth | |
| 6,251,571 | B1 | 6/2001 | Dessauer et al. | |
| 6,265,344 | B1 | 7/2001 | Shimbo et al. | |
| 6,322,950 | B1 | 11/2001 | Sorori et al. | |
| 6,433,891 | B1 | 8/2002 | Yu et al. | |
| 6,468,711 | B1 | 10/2002 | Sorori et al. | |
| 6,479,431 | B1 | 11/2002 | McFall et al. | |
| 6,606,168 | B1 | 8/2003 | Rylander | |
| 6,613,715 | B1 | 9/2003 | Kutami et al. | |
| 2001/0029236 | A1 | 10/2001 | Kutami et al. | |
| 2002/0187897 | A1 | 12/2002 | Ishida et al. | |
| 2003/0003399 | A1 | 1/2003 | Muller et al. | |
| 2003/0125205 | A1 | 7/2003 | Kaneko et al. | |
| 2003/0125206 | A1 | 7/2003 | Bhatt et al. | |
| 2004/0029056 | A1 | 2/2004 | Tsukada | |

FOREIGN PATENT DOCUMENTS

| | | |
|---|---|---|
| WO | WO01/32411 | 5/2001 |

* cited by examiner

*Primary Examiner*—Bruce H. Hess

(57) ABSTRACT

A layered image-forming composite can include a substrate having a background color layer and a color-forming layer applied thereon. The color-forming layer includes a leuco dye that can be developed upon exposure to energy to produce a developed color. The background layer and the color-forming layer can each contribute to the overall appearance of the composite either before and/or after development of the leuco dye. In one aspect, the color-forming layer can have a thickness sufficiently thin to allow a portion of the fixed background color to be visible through a developed portion of the color-forming layer. Optionally, the color-forming layer can be applied in a filter pattern, e.g., halftone, moiré, stochastic, etc. in order to provide unique visual effects to the layered composite.

42 Claims, 2 Drawing Sheets

MULTILAYERED COLOR COMPOSITIONS AND ASSOCIATED METHODS

FIELD OF THE INVENTION

The present invention relates generally to color images and methods of producing color images having various effects. More particularly, the present invention relates to layered composite materials including color-forming compositions.

BACKGROUND OF THE INVENTION

Formation of an image on various substrates can be accomplished in a wide variety of ways. Relatively recently, interest and research has increased in the area of thermosensitive color-changing or color-forming materials, including inks and coating materials. These thermosensitive color-changing materials can be used in a myriad of applications which benefit from an undeveloped state being either colorless or having a particular color and a developed state having a distinctly different color appearance. Transformation from the undeveloped state to the developed state is most often via a chemical reaction between a leuco dye and a suitable activator or reducing agent that can be present in the color-changing material(s). Commercially useful thermosensitive color-changing materials can have a somewhat limited color palette; however, research efforts continue to focus on improving available color choices and properties such as light stability, fade resistance, intensity, and the like.

One recent development includes the use of infrared absorbers in conjunction with leuco dyes. The infrared absorbers can be specifically selected to produce heat under exposure to electromagnetic radiation at a given frequency, or range of frequencies. The heat then provides the necessary energy for the leuco dye to be developed. In this way, precise control can be used to selectively develop portions of the leuco dye to form an image. One example of this technology is the LightScribe (trademark of Hewlett-Packard Company) CD and DVD marking system.

In accordance with this general technology, materials and methods that further enhance the above image forming technologies and improve commercially useful image properties continue to be sought through research and development.

SUMMARY OF THE INVENTION

It has been recognized that it would be advantageous to develop improved methods and materials which can be used to produce unique color combinations and visual affects, particularly in the context of undeveloped and developed color-changing or color-forming materials.

As such, in one aspect of the present invention, a layered image-forming composite can include a substrate having a background color layer and a color-forming layer applied thereon. The color-forming layer includes a leuco dye that can be developed upon exposure to energy to produce a developed color. The background layer and the color-forming layer can each contribute to the overall appearance of the composite either before and/or after development of the leuco dye. In one aspect, the color-forming layer can have a thickness sufficiently thin to allow a portion of the fixed background color to be visible through a developed portion of the color-forming layer. Alternatively, at least one of the background color layer and the color-forming layer can be applied in a filter pattern in order to provide unique visual effects to the layered composite.

Additional features and advantages of the invention will be apparent from the following detailed description, which illustrates, by way of example, features of the invention.

DETAILED DESCRIPTION OF THE PREFERRED EMBODIMENT(S)

Figure 1:
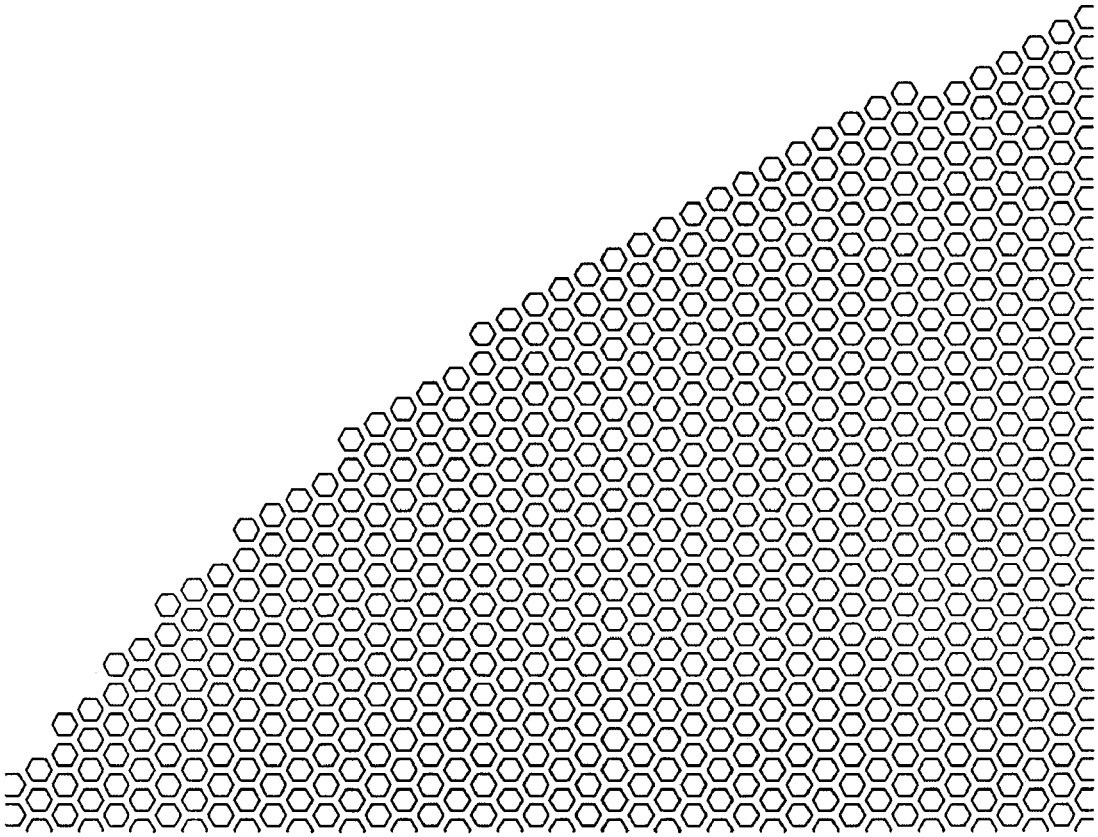
FIG. 1 is an illustration of a halftone pattern of closely packed hexagonal dots related to an embodiment of the present invention.

Reference will now be made to exemplary embodiments and specific language will be used herein to describe the same. It will nevertheless be understood that no limitation of the scope of the invention is thereby intended. Alterations and further modifications of the inventive features described herein, and additional applications of the principles of the invention as described herein, which would occur to one skilled in the relevant art and having possession of this disclosure, are to be considered within the scope of the invention. Further, before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used.

The singular forms "a," "an," and "the" include plural referents unless the context clearly dictates otherwise. Thus, for example, reference to "a color" includes reference to one or more of such properties, and reference to "applying electromagnetic radiation" includes reference to one or more of such steps.

As used herein, the term "color-forming composition" typically includes a leuco dye and other optional components, e.g., an infrared absorber, activator, resins, stabilizers, and the like. These components can work together upon exposure to heat and/or electromagnetic radiation to reduce the leuco dye to produce a dye having color or a change in color. For purposes of the present invention, the term "color" or "colored" can refer to change in visible absorbance that occurs upon development, including development to black, white, or traditional colors. An undeveloped leuco dye can be colorless or may have some color which changes upon development to a different color. Thus, the term "color-forming" includes color-changing, e.g., modification from one color to another color, as well as color-producing, e.g., modification from colorless to a color.

The term "color" includes generally understood visible colors as well as black and white.

As used herein, "halftone" refers to a non-continuous pattern which can be used to produce an image. Halftone patterns are known in the art and can be produced in a wide variety of patterns, depending on a desired affect. Individual dots or lines within the halftone pattern can be either adjacent or separate from one another.

As used herein, "developing," "development," or the like refers to an interaction or reaction which can reduce a leuco dye to produce a visible change in or production of color through reduction to the corresponding colored leuco dye.

As used herein, "absorber" refers generally to an optional electromagnetic radiation sensitive agent that can generate heat or otherwise transfer energy to surrounding molecules upon exposure to a predetermined frequency of electromagnetic radiation. The predetermined frequency is typically different from one absorber composition to the next. When admixed with or in thermal contact with a leuco dye and/or activator, an absorber can be present in sufficient quantity so as to produce heat sufficient to at least partially develop the leuco dye in accordance with embodiments of the present invention.

As used herein, "infrared absorber" refers generally to an infrared radiation sensitive absorber that can generate heat or otherwise transfer energy to surrounding molecules upon exposure to infrared radiation. Infrared radiation includes near infrared radiation in the range of from about 700 nm to about 40 μm, although about 700 nm to about 1200 nm is common for most near infrared applications.

As used herein, "thermal contact" refers to the spatial relationship between an absorber and a color-forming composition. For example, when an absorber is heated by interaction with radiation, the heat generated by the absorber should be sufficient to cause the leuco dye of the color-forming composition to become colored, through chemical reaction. Thermal contact can include close proximity between an absorber and a color-forming composition, which allows for heat transfer from the absorber toward the leuco dye and/or activator. Thermal contact can also include actual contact between an absorber and leuco dye, such as in immediately adjacent layers, or in an admixture including both constituents.

As used herein, "optimization" and "optimized" refer to a process of selection of components of the color-forming composite that results in a rapidly developable composition under a fixed period of exposure to radiation. For example, compositions of the present invention can be optimized for development using 780 nm laser light in which substantially the entire color-forming layer exposed to the infrared radiation is developed in less than a predetermined period of time, e.g., 100 μsec. However, "optimized" does not necessarily indicate that the color-forming layer is developed most rapidly at a specific wavelength, but rather that the layer can be developed within a specified time frame using a given infrared radiation source. An optimized composition would also indicate an ambient light stability and fade resistance over extended periods of time, e.g., several months to years.

As used herein, "optical disk" is meant to encompass audio, video, multi-media, and/or software disks that are machine readable in a CD and/or DVD drive, or the like. Examples of optical disk formats include writeable, recordable, and rewriteable disks such as DVD, DVD-R, DVD-RW, DVD+R, DVD+RW, DVD-RAM, CD, CD-ROM, CD-R, CD-RW, and the like. Other like formats may also be included, such as similar formats and formats to be developed in the future.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

In accordance with the present invention, a layered image-forming composite can include a substrate having multiple color layers. Specifically, a background color layer can be applied to the substrate. The background color layer can have a fixed background color. A color-forming layer can also be applied to the background color layer. The color-forming layer typically includes a leuco dye. Further, the color-forming layer can have a thickness that allows the fixed background color to affect the appearance of the composite both before and after development of portions of the leuco dye within the color-forming layer. Typically, the color-forming layer can be sufficiently thin to allow a portion of the fixed background color to be visible through a developed portion of the color-forming layer.

Substrate and Background Layer

Any suitable substrate can be used which provides mechanical support sufficient for a particular intended application. For example, the substrate can be formed of a polymer, paper, coated paper, metal, glass, or combinations of these materials. The substrate can be formed of a single layer, or can be a laminate or multi-layered substrate. Non-limiting examples of suitable polymeric materials can include polyesters such as polyethylene terephthalate (PET), cellulose esters such as cellulose triacetate, cellulose acetate propionate, and cellulose acetate butyrate; polyamides; polycarbonates; polyimides; polyolefins; polysulfonamides; and composites or combinations thereof. In one embodiment, the substrate can be an optical disk. Currently, due partly to cost considerations, optical disks are prepared using polycarbonates, though other materials can also be acceptable for use. Alternatively, the substrate can be an optical film. In one aspect, the optical film can be an optically clear polyester film. Other suitable optical films can include polyether sulfone (PES), poly(ester napthalate) (PEN), and the like.

Specifically, a background color layer can be applied to the substrate. The background color layer can include a background colorant having a fixed background color. Generally, the background colorant can be any non-leuco colorant that can provide a background color. The background colorant can be any lightfast colorant such as, but not limited to, pigments, dyes, fluorescents, or the like. Typically, pigments provide good color properties with fade resistance and UV light stability. Non-limiting examples of suitable pigments can include yellow 109, orange 34, orange 64, red 166, red 53:1, violet 19, green 7 and blue 60. For example, Ciba® Irgalite®, Cromophtal®, Irgazin®, and Monostral® pigments can be used.

Typically, the background color layer can contain additional components such as resins, lacquers, binders, stabilizers, antioxidants, and other known additives that can help to improve coating, durability, and/or performance characteristics. The background color layer can include a binder or resin that can secure the background colorant to a surface when applied. Ultraviolet (UV) curable resins provide a good medium for securing the background colorant. Several exemplary UV curable resins suitable for use in the present invention are discussed below in more detail. The background layer can be applied at almost any thickness. A background layer thickness less than about 8 μm typically provides good color density and reduced colorant usage.

In an alternative embodiment, the background color layer can be designed such that the fixed background color appears as a combination of the background colorant and the color of the underlying substrate material, e.g., a metallic layer, solid color, etc. Thus, in some embodiments, the substrate can contribute to the appearance of the fixed background color, as discussed in more detail below, and a perceived color can ultimately be a combination of the substrate color, fixed background color, and developed color from the leuco dye or color-forming layer.

Color-Forming Layer

In addition to the background color layer, a color-forming layer can be included in the layered image-forming color composites of the present invention. A color forming composition can be prepared and applied to the substrate. The color forming composition can be applied to the substrate as a layer directly contacting the substrate. Alternatively, the color forming layer can be applied to the substrate as a layer over the background color layer. Thus, the term "on the substrate" includes embodiments wherein an additional layer is placed in between the layer identified as on the substrate, although no actual contact occurs. Therefore, the color forming layer can be overprinted or underprinted with respect to the background layer.

As mentioned, the color-forming composition typically includes a leuco dye. Depending on the specific leuco dye, additional components can be used to allow development of the leuco dye. For example, activators can be included as a reducing agent to facilitate formation of the developed or reduced state of the leuco dye. Additionally, absorbers can be included to improve resistance to fade, increase light stability, and/or provide a localized heat source tuned to a specific frequency of electromagnetic radiation, as discussed below.

Regardless of additional components, the color-forming layer can have a thickness and or filter pattern that allows the fixed background color to affect the appearance of the layered image-forming composite both before and after development of portions of the leuco dye within the color-forming layer. Typically, the color-forming layer can be sufficiently thin to allow a portion of the fixed background color to be visible through a developed portion of the color-forming layer. A desirable thickness can depend on the concentration of leuco dye and other components, as well as intensity of the specific leuco dye. However, as a general guideline, the color-forming layer can have thicknesses from about 3 μm to about 15 μm. Further, thicknesses from about 6 μm to about 8 μm have shown a good balance between allowing background color therethrough while also preserving at least some color intensity of the color-forming layer. Additionally, thicker layers can slow the development time required to achieve adequate development of the leuco dyes. Further, the color-forming layer can be applied to the entire substrate or merely portions thereof, depending on the desired effects. Similarly, a plurality of leuco dyes can be included in the color-forming layer either in a mixture, in distinct regions, or in separate layers to produce color images having multiple colors.

The leuco dye can be any number of colorants that exhibit color change or formation upon exposure to certain types of energy. Non-limiting examples of suitable leuco dyes include fluorans, phthalides, amino-triarylmethanes, aminoxanthenes, aminothioxanthenes, amino-9,10-dihydroacridines, aminophenoxazines, aminophenothiazines, aminodihydro-phenazines, aminodiphenylmethanes, aminohydrocinnamic acids (cyanoethanes, leuco methines) and corresponding esters, 2(p-hydroxyphenyl)-4,5-diphenylimidazoles, indanones, leuco indamines, hydrozines, leuco indigoid dyes, amino-2,3-dihydroanthraquinones, tetrahalo-p,p'-biphenols, 2(p-hydroxyphenyl)-4,5-diphenylimidazoles, phenethylanilines, phthalocyanine precursors (such as those available from Sitaram Chemicals, India), and mixtures thereof. Experimental testing has shown that fluoran based dyes are one class of leuco dyes which exhibit desirable properties. Additionally, phthalides and aminotriarylmethanes can also be desirable for use in certain applications.

Several non-limiting examples of suitable fluoran-based leuco dyes include 3-diethylamino-6-methyl-7-anilinofluorane, 3-(N-ethyl-p-toluidino)-6-methyl-7-anilinofluorane, 3-(N-ethyl-N-isoamylamino)-6-methyl-7-anilinofluorane, 3-diethylamino-6-methyl-7-(o,p-dimethylanilino)fluorane, 3-pyrrolidino-6-methyl-7-anilinofluorane, 3-piperidino-6-methyl-7-anilinofluorane, 3-(N-cyclohexyl-N-methylamino)-6-methyl-7-anilinofluorane, 3-diethylamino-7-(m-trifluoromethylanilino)fluorane, 3-dibutylamino-6-methyl-7-anilinofluorane, 3-diethylamino-6-chloro-7-anilinofluorane, 3-dibutylamino-7-(o-chloroanilino) fluorane, 3-diethylamino-7-(o-chloroanilino)fluorane, 3-di-n-pentylamino-6-methyl-7-anilinofluoran, 3-di-n-butylamino-6-methyl-7-anilinofluoran, 3-(n-ethyl-n-isopentylamino)-6-methyl-7-anilinofluoran, 3-pyrrolidino-6-methyl-7-anilinofluoran, 1(3H)-isobenzofuranone,4,5,6,7-tetrachloro-3,3-bis[2-[4-(dimethylamino)phenyl]-2-(4-methoxyphenyl)ethenyl], 2-anilino-3-methyl-6-(N-ethyl-N-isoamylamino)fluorane (S-205 available from Nagase Co., Ltd), and mixtures thereof. Suitable aminotriarylmethane leuco dyes can also be used in the present invention such as tris(N,N-dimethylaminophenyl) methane (LCV); tris(N,N-diethylaminophenyl) methane(LECV); tris(N,N-di-n-propylaminophenyl) methane (LPCV); tris(N,N-din-butylaminophenyl) methane (LBCV); bis(4-diethylaminophenyl)-(4-diethylamino-2-methyl-phenyl) methane (LV-1); bis(4-diethylamino-2-methylphenyl)-(4-diethylamino-phenyl) methane (LV-2); tris(4-diethylamino-2-methylphenyl) methane (LV-3); bis(4-diethylamino-2-methylphenyl)(3,4-dimethoxyphenyl) methane (LB-8); aminotriarylmethane leuco dyes having different alkyl substituents bonded to the amino moieties wherein each alkyl group is independently selected from C1–C4 alkyl; and aminotriaryl methane leuco dyes with any of the preceding named structures that are further substituted with one or more alkyl groups on the aryl rings wherein the latter alkyl groups are independently selected from C1–C3 alkyl. Other leuco dyes can also be used in connection with the present invention and are known to those skilled in the art. Additional discussion of some of these leuco dyes may be found in U.S. Pat. Nos. 3,658,543 and 6,251,571, each of which are hereby incorporated by reference in their entireties.

Typically, the leuco dye can be present in color-forming compositions of the present invention at from about 1 wt % to about 40 wt %. Although amounts outside this range can be successfully used, depending on the other components of the composition, amounts of from about 5 wt % to about 20 wt % frequently provide adequate results.

The background color layer and/or color-forming layer can be applied via any number of known printing technologies such as, but not limited to, screen-printing, spin coating, roller coating, sputtering, spray coating, thermal spray deposition, offset, gravure, ink-jet, electrostatic, laser, liquid embossing, and liquid electrophotography. Typically, the background and color-forming layer can be applied using screen-printing, spin coating, or spray coating. For example, the layers can be applied using a screen, rotary screen, flexographic press, or the like.

Figure 2:
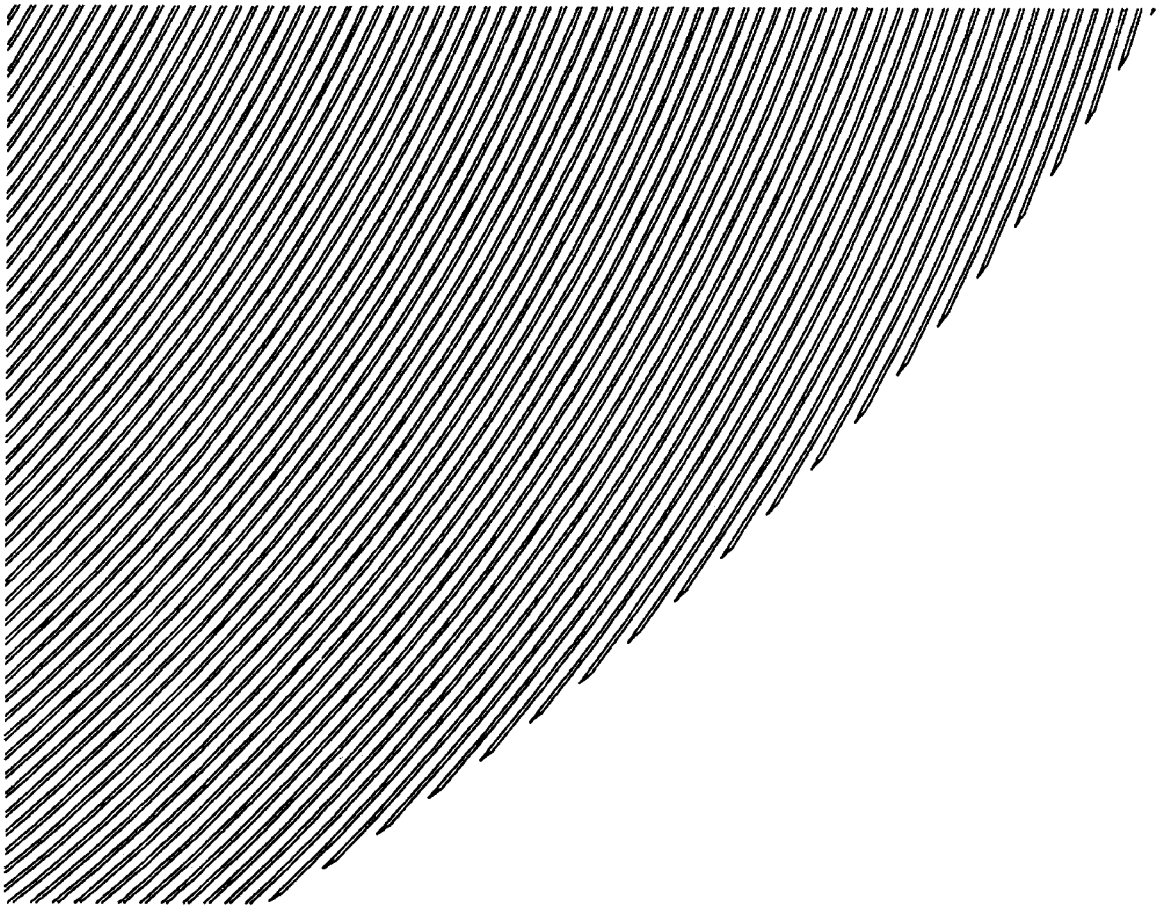
FIG. 2 is an illustration of a halftone pattern of curved or spiral lines which are substantially parallel related to an embodiment of the present invention.

In an additional aspect of the present invention, at least one of the color-forming layer and the background layer can be applied in a filter pattern. Typically, printing the color-forming layer in a filter pattern results in a more dramatic effect. The filter pattern can be any of a number of patterns such as, but not limited to, halftone patterns, stochastic pattern, moiré patterns, or the like. The filter pattern can be formed from a series of closely spaced dots, lines, or other shapes. The individual dots can be any desired shape, for example, hexagonal, round, square, random (stochastic), elongate, star, or the like. The individual dots can be applied such that substantially all of the dots are interconnected or such that spacings are left between dots. For example, FIG. 1 illustrates a halftone pattern of spaced hexagonal dots. Spaced hexagonal dots results in a muted effect to a perceived image developed in the leuco dye. FIG. 2 illustrates a spiral halftone pattern having a series of curved parallel lines. This spiral pattern results in images appearing faded or muted with good resolution. Similarly, the placement of stochastic dots can result in a high-lighted appearance of an image.

Other effects can be produced such as a mottled, mirrored, or diffractive modulation. In one aspect, the filter pattern can be viewed as a filter on a developed image similar to filters used in image-processing software. For example, the filter pattern can be printed to simulate color halftone, crystallize, facet, fragment, and pointillize image filters. Spaces in between the printed color-forming layer allow the background color to dilute the developed image and affect the overall appearance when viewed from a distance. Further, the filter pattern can be adjusted to produce a modulation of shade and texture to an image. Ambient light can then pass through the color-forming layer, background layer, and/or substrate to produce a desired effect. In some embodiments, the substrate can also contribute to the perceived image. For example, when the substrate is an optical disk, the inner metallic layer can add a diffractive (rainbow) sheen to the perceived image under viewing from various angles. In one detailed aspect of the present invention, the halftone pattern can be closely packed hexagonal, stochastic, checkered, angled, shaped, distorted, or other pattern, or combinations thereof. Additionally, the line count and/or dot density can be varied across a layer.

Color Mixing

As mentioned above, one aspect of the present invention involves forming layers of color which each contribute to a single perceived color. The color-forming layer can have a thickness sufficiently thin to allow a portion of the fixed background color to be visible through a developed portion of the color-forming layer. Thus, the layered image-forming composite of the present invention can include a substrate having a background layer and an undeveloped color-forming layer. Selected portions of the color-forming layer can then be developed in accordance with known principles or as described in more detail below using specific absorbers. The developed portions of the color-forming layer can have a developed color that is distinct, which can be as a result of color mixing, e.g., hue, intensity, etc. More specifically, a perceived color can be realized that is a combination of at least the background color and the developed color. In other words, as the color-forming layer is relatively thin, the background color influences the perceived color of the developed portions of the color-forming layer. Thus, the thickness of the color forming layer can affect the perceived color and/or the appearance of a final image. Similarly, the background layer can be printed in a sufficiently thin layer allowing color from the substrate to pass through the background and color-forming layers.

Infrared Radiation Absorber

An electromagnetic radiation absorber can optionally be part of the layered image-forming composite. The absorber can be placed in thermal contact with the leuco dye and/or activator as a component that can be used to optimize development of the color-forming composition at a predetermined speed and/or wavelength of applied radiation. The absorber can act as an energy antenna, providing heat to surrounding areas upon interaction with an energy source. As a predetermined amount of heat can be provided to the system by applying energy to the electromagnetic radiation absorber, matching of the electromagnetic radiation frequency and intensity to the absorber used can be carried out to optimize the system.

Various absorbers will act as an antenna to absorb electromagnetic radiation of specific frequencies and ranges. Of particular interest is laser light having infrared frequencies from about 600 nm to about 1200 nm. Therefore, the present invention can provide color-forming compositions optimized for use in devices that emit frequencies within this range. Typical commercial IR lasers found in common CD and DVD equipment provide energy at a wavelength of about 650, 780, and 900 nm, while other commercial imaging lasers such as GaAs lasers can operate at about 830 nm. Thus, the compositions of the present invention using appropriate infrared radiation absorbers can be used in equipment that is already commonly available on the market. In one specific embodiment, the compositions of the present invention can include an infrared absorber such that the image-forming composite is optimized for development using infrared radiation from about 760 nm to 800 nm, such as about 780 nm.

The absorber can be configured to be in a heat-conductive relationship with the leuco dyes of the present invention. For example, the absorber can be placed in the same layer as the leuco dye as part of an admixture, or can be in a separate layer. Thus, the absorber can be admixed with or in thermal or electrical contact with the color-forming composition. In one aspect of the present invention, the absorber can be applied to the substrate in a separate adjacent layer that can be optionally spin-coatable or screen-printable, prior to or after applying the color-forming composition as a layer. Alternatively, the radiation absorber can be applied in a common liquid carrier with the color-forming composition. In one embodiment, consideration can also be given to choosing the absorber such that any light absorbed in the visible range does not adversely affect the graphic display or appearance of undeveloped leuco dye.

Although an inorganic compound can be used, e.g., ferric oxide, carbon black, selenium, and the like, the radiation absorber typically can be an organic compound, such as, but not limited to polymethine dyes, polymethyl indolium dyes, metal complex IR dyes, indocyanine green, heterocyclic compounds and combinations thereof. Other suitable radiation absorbers can include, but are not limited to, guaizonyl dyes, croconium dyes, cyanine dyes, squarylium dyes, chalcogenopyryloarylidene dyes, metal thiolate complex dyes, oxyindolizine dyes, merocyanine dyes, indolizine dyes, pyrylium dyes, quinoid dyes, quinone dyes, phthalocyanine dyes, naphthalocyanine dyes, azo dyes, hexafunctional polyester oligomers, heterocyclic compounds, and combinations thereof. Suitable polymethyl indolium compounds are available from Aldrich Chemical Company. Other suitable absorbers can also be used in the present invention as are known to those skilled in the art, and can be found in such references as "Infrared Absorbing Dyes", Matsuoka, Masaru, ed., Plenum Press, New York, 1990 (ISBN 0-306-

43478-4) and "Near-Infrared Dyes for High Technology Applications", Daehne, Resch-Genger, Wolfbeis, Kluwer Academic Publishers (ISBN 0-7923-5101-0).

The absorber can be present in the color-forming composition in an amount from about 0.001% to about 10% by weight, and typically, from about 0.5% to about 1% by weight, although other weight ranges may be desirable depending on the activity of the particular absorber. These weight percentages represent an amount of absorber that can be present when included as part of the color-forming composition. These weight percentages can be altered in other embodiments, such as when the absorber is applied separately with respect to one or more other layers.

Other Optional Ingredients

These layers can include additional components such as, but not limited to, colorants, light stabilizers, anti-fade agents, liquid and vapor resistance additives, scratch inhibitors, plasticizers, lubricants, surfactants, liquid vehicles, binders, and other known additives.

Non-limiting examples of suitable light stabilizers include hindered amines such as TINUVIN 292, TINUVIN 123, TINUVIN 144 (available from Ciba-Geigy Company) and UV absorbers such as benzophenones, benzotriazoles, acetanilides, cyanoacrylates, and triazines.

Depending on the specific leuco dye, the color-forming composition can optionally include a reducing agent, i.e. activators. Typical activators include 1-phenyl-3-pyrozolidone (phenidone), hydrazine, formamide, formic acid, hexaarylbiimidazoles (HABI), ascorbic acid, phenols and substituted phenols, e.g., hydroquinone, and mixtures thereof.

The addition of appropriate stabilizers aids in preventing undesired radiation, e.g., sunlight, fluorescent light, or UV radiation during UV cure, from disabling the radiation absorber prior to development using a radiation source. Further, stabilizers can aid in preventing undesirable changes in optical density of the color-forming composition which may occur due to unintended development of the leuco dye either before or after development using a radiation source. Accordingly, suitable stabilizers can include chromans, thiolane-nickel complexes, spiroindanes, and other known stabilizer compositions. Similarly, anti-fade agents such as vitamin E, vitamin E analogs such as vitamin E succinate and succinate esters of long chain alcohols, astaxanthin, ascorbic acid, carotene, chroman, and mixtures thereof can be used.

In order to provide desirable color-forming properties and coatability, various factors such as viscosity and solids content can also be considered. The color-forming compositions of the present invention can have less than about 10 wt % of solids, which typically provides good coating properties.

The color-forming composition can also include a binder. Various binders can influence the development properties of the color-forming composition such as development speed, light stability, and wavelengths that can be used to develop the composition. Suitable binders can include, but are not limited to, polymeric materials such as polyacrylate from monomers and oligomers, polyvinyl alcohols, polyvinyl pyrrolidines, polyethylenes, polyphenols or polyphenolic esters, polyurethanes, acrylic polymers, and mixtures thereof.

Acceptable binder materials can also include, by way of example, UV curable polymers such as acrylate derivatives, oligomers, and monomers, such as included as part of a photo package. A photo package can include a light absorbing species that may be sensitized for curing using UV or electron beam curing systems. For example, in one embodiment, the binder included within the photo package can be configured to initiate reactions for curing of a lacquer, such as, benzophenone derivatives. Other examples of photoinitiators for free radical polymerization monomers and prepolymers include, but are not limited to, thioxanethone derivatives, anthraquinone derivatives, acetophenones and benzoine ethers. Binder materials based on cationic polymerization resins may require photo-initiators such as aromatic diazonium salts, aromatic halonium salts, aromatic sulfonium salts and metallocene compounds. An example of one suitable binder can include Nor-Cote CDG000 which contains a photoinitiator (hydroxy ketone) and organic solvent acrylates; e.g., methyl methacrylate, hexyl methacrylate, beta-phenoxy ethyl acrylate, and hexamethylene acrylate. Other acceptable binders can include CN293 and CN294 (acrylated polyester oligomers) as well as CN-292 (low viscosity polyester acrylate oligomer), SR-351 (trimethylo:propane triacrylate), SR-395(isodecyl acrylate) and SR-256(2(2-ethoxyethoxy)ethyl acrylate) available from Sartomer Co. In choosing an appropriate binder, it is typically desirable to choose a binder that can be cured by radiation, and which does not also cause a color change in the leuco dye or otherwise decrease the stability of the color-forming composition.

The color-forming layer can further include a liquid carrier, which can act to improve coating performance, but which can be removed upon coating through known liquid removal processes. Typically, at least a portion of the liquid carrier can be driven off or allowed to evaporate after the coating process is complete. The liquid carrier can include, but is not limited to, solvents such as methylethyl ketone, isopropyl alcohol or other alcohols and diols, water, surfactants, and mixtures thereof.

Additionally, a protective layer can be applied to the color-forming layer in order to provide additional mechanical and chemical protection to the color-forming layer. The protective layer can be formed of any known resin, binder, or the like. Further, this layer can include stabilizers, anti-fade agents or other components which can improve the durability and useful life of the image-forming composite. Optionally, the protective layer can include colorants which can affect the appearance or image without interfering with development of the leuco dye or the desired color effects.

Electromagnetic Radiation Application for Development

In one embodiment of the present invention, the color-forming composition can be applied to a substrate, as described previously. Additionally, as mentioned, a variety of substrates can be used such as optical disks, polymeric surfaces, glass, ceramic, or cellulose papers. In one embodiment, the color-forming composition can be applied to an optical disk and select portions thereof developed using a laser or heat source. Typically, an image to be formed on the surface is digitally stored and then rasterized or spiralized. The resulting data is delivered to an infrared radiation source which exposes portions of the color-forming composition to infrared radiation while the optical disk is spinning. The infrared radiation source can be a laser such as those found in commercially available CD/DVD writeable and/or rewriteable systems.

The present invention relates generally to forming color images on a substrate using the color-forming compositions of the present invention. Once the color-forming composition is applied to a substrate the conditions under which the color-forming compositions of the present invention are developed can be varied. For example, one can vary the electromagnetic radiation frequency, heat flux, and exposure time. The amount of heat that can be applied depends partially on the activation energy of the activator and/or radiation absorber described above. However, the heat applied is typically sufficient to develop the leuco dye without also decomposing the color-forming layer. Variables such as spot size and laser power will also affect any particular system design and can be chosen based on the desired results. With these variables, the electromagnetic radiation source can direct electromagnetic radiation to the color-forming layer in accordance with data received from a signal processor. Further, leuco dye and/or radiation absorber concentration and proximity to one another can also be varied. Typically, the absorber and the leuco dye are present in a common layer, and thus, concentration ratios can be considered for a desired affect. However, if the color-forming composition and absorber are placed in separate layers, proximity can be considered.

The leuco dyes of the color-forming compositions can be developed using lasers having from about 15 mW to about 100 mW power usage, although lasers having a power outside this range can also be used. Typically, lasers having from about 30 mW to about 50 mW are readily commercially available. The spot size can be determined by considering the electromagnetic radiation source, and can range from about 1 μm to about 200 μm, though smaller or larger sizes can also be used. In one embodiment, a radiation spot size of from about 10 μm to about 60 μm can also be utilized. In a further aspect, spot sizes of 20 μm by 50 μm can provide a good balance between resolution and developing speed.

Heat flux is a variable that can be altered as well, and can be from about 0.05 J/cm$^2$ to about 5.0 J/cm$^2$ in one embodiment, and from about 0.3 J/cm$^2$ to about 0.5 J/cm$^2$ in a second embodiment. Heat flux in these ranges allow for development of leuco dyes in from about 10 microseconds to about 100 microseconds per dot in some embodiments. Those skilled in the art can adjust these variables and those discussed immediately above to achieve a variety of resolutions and developing times. Further, printing a color-forming layer on an optical disk without a background layer tends to result in images which appear out of focus or doubled. This is partially the result of energy passing through the leuco dye layer and thus exposing at a given point. A portion of the energy passes through the remaining clear polycarbonate and reflects off of the metal layer. The reflected energy passes through the leuco dye layer at a slightly different position, thus further developing the color-forming layer. In some embodiments this double-exposure can be desirable. However, typically this effect can be minimized or eliminated by printing the background layer in between the substrate and the color-forming layer.

The following examples illustrate exemplary embodiments of the invention. However, it is to be understood that the following is only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following example provides further detail in connection with what is presently deemed to be a practical embodiment of the invention.

EXAMPLES

Example 1

A color-forming composition was prepared having the composition shown in Table 1.

TABLE 1

| Ingredient | % by weight |
|---|---|
| Acrylate resins monomers and oligomers | 50 |
| Bisphenol A activator | 11 |
| Zn stearate stabilizer | 3.6 |
| 715 dye IR absorber | 1.3 |
| Darocur 4265 photoinitiator | 2.4 |
| Leuco dye BK400 | 31.7 |

The acrylate resins, activator, IR absorber, stabilizer and photoinitiator were combined into a mixture. The mixture was then placed in an opaque dark bottle and mixed overnight by rolling slowly at 1–5 rpm. Subsequently, the leuco dye was mixed by hand into the above mixture to form a color-forming composition. The color-forming composition was passed through a laboratory three-roll mill until the mixture was homogenous in appearance and uniform in color. The composition was stored overnight at room temperature on a jar roller at less than 1 rpm.

A background layer composition was prepared by thoroughly mixing 20 grams of JZB14 Blaze Orange fluorescent pigment to 30 grams of CDG0-00 resin (both commercially available from NorCote Company). A second background layer composition was prepared in a similar manner using JZB17 Saturn Yellow fluorescent pigment. These background layers were coated to about 6 μm thickness.

A patterned 460 mesh polyester screen stretched at 45 degrees having a solvent-resistant emulsion built up to 2 microns and a squeegee blade of 70 to 90 durometer hardness was prepared. The label side of two CD-R compact disks was screen printed, one with each background composition. The specified parameters resulted in a uniform film of 6 to 8 μm in thickness. The background layer film was cured by passing the disks under a 6 inch, 200 watt/inch Hg arc discharge lamp near the focal point at 55 ft per minute. The resulting background film was sufficiently thin to allow the inner metal layer to be visible therethrough with an orange and yellow iridescent tint.

Using a stretched screen as above, the color-forming composition was screen-printed to a thickness of about 6 to 8 μm on each of the disks. The color-forming layer was then cured as described above at 23 feet per minute.

The disks were then developed to form various images with a LightScribe™ system from Hewlett-Packard. A 780 nm, 45 mW laser was focused on the surface and a raster image was produced at a density of 1200 tracks/inch.

The developed image had a relatively normal appearance with a black image on either light pink-orange or a muddy brown background. There was a subtle rainbow effect across the entire image as the disk was tilted.

Example 2

The same procedure was followed as in Example 1, except the color-forming layer was printed using a texture spiral pattern as shown in FIG. 2. The disks printed with a spiral pattern over a green background were iridescent light green. The labeled image was more muted than in Example 1 and appears to be buried under a translucent layer. Disks printed with a spiral pattern over orange had a similar appearance. Again, the orange was much lighter than in Example 1. Further, the image was muted, but appeared high-lighted as the disk was tilted.

Example 3

The same procedure was followed as in Example 1, except the color-forming layer was printed using a close-packed hexagonal halftone pattern as shown in FIG. 1. The disks printed with a hexagonal pattern on green were very striking due to a lensing effect as the disk was tilted. Specifically, the image intensified in contrast as the disk was moved closer to the viewer, becoming very dramatically dark at certain angles. The entire surface was shiny and bright. Disks printed with a hexagonal pattern over orange background had a similar appearance, but were not as shiny as the green background samples.

Table 2 includes a summary of optical measurements on the above prepared disks. Specifically, the Lab color space model was used to measure luminance (L*), red-green sensation (a*), and yellow-blue sensation (b*). Chroma (C) and hue (h) can be calculated from the values of a* and b* using Equations 1 and 2.

$$C\ \sqrt{a^{*2}+b^{*2}} \tag{1}$$

$$h^{*}\arctan(b^{*}/a^{*}) \tag{2}$$

The percent reflection (% R) was also measured across the range of 200 nm to 800 nm with the value at 550 nm being shown in Table 2.

TABLE 2

| Sample | % R at 550 nm | L* | a* | b* | h | C |
|---|---|---|---|---|---|---|
| Ex. 1 on yellow | 6.2 | 29.6 | −.58 | .19 | −.3 | .6 |
| Ex. 2 Spiral pattern on yellow | 10.1 | 36.5 | −14.3 | 17.3 | −.88 | 22.5 |
| Ex. 3 Hex pattern on yellow | 7.2 | 30.9 | −10.86 | 12.39 | −.85 | 16.47 |
| Ex. 1 on orange | 5.3 | 28.0 | 1.2 | .25 | .2 | 1.25 |
| Ex. 2 Spiral pattern on orange | 4 | 27.8 | 11.3 | 1.3 | .1 | 11.38 |
| Ex. 3 Hex pattern on orange | 3.8 | 26.7 | 9.5 | 1.78 | .18 | 9.7 |

The above measurements revealed that the yellow hexagonal and spiral patterns were brighter as evidenced by the increased reflectivity at 550 nm, while the orange samples were duller. This was somewhat unexpected, since both patterned orange disks appeared visually brighter than the corresponding yellow patterned disks. Additionally, each of the disks exhibited substantial reflection in the infrared range.

It is to be understood that the above-referenced arrangements are illustrative of the application for the principles of the present invention. Thus, while the present invention has been described above in connection with the exemplary embodiments of the invention, it will be apparent to those of ordinary skill in the art that numerous modifications and alternative arrangements can be made without departing from the principles and concepts of the invention as set forth in the claims.

What is claimed is:

1. A layered image-forming composite, comprising:

a) a substrate;

b) a background color layer having a fixed background color; and c) a color-forming layer comprising a leuco dye, said color-forming layer and background color layer being configured on the substrate such that an image is the result of the fixed background color and developed portions of the color forming layer, and wherein at least one of the color-forming layer and the background layer is applied in a filter pattern.

2. The composite of claim 1, wherein the color-forming layer is sufficiently thin to allow a portion of the fixed background color to be visible through the developed portion of the color-forming layer.

3. The composite of claim 2, wherein the color-forming layer has a thickness from about 3 μm to about 15 μm.

4. The composite of claim 3, wherein the color-forming layer has a thickness of from about 6 μm to about 8 μm.

5. The composite of claim 1, wherein the filter pattern is selected from the group consisting of halftone, stochastic, checkered, moiré, spiral, and combinations thereof.

6. The composite of claim 1, wherein the filter pattern is a halftone pattern.

7. The composite of claim 1, where the color-forming layer is printed in a filter pattern.

8. The composite of claim 1, wherein a portion of the color-forming layer is developed to form a developed color.

9. The composite of claim 8, wherein a perceived image is generated that is a combination of the background color and the developed color.

10. The composite of claim 9, wherein the color-forming layer is printed in a filter pattern and the perceived image is the result of developed color and background color which is not transmitted through the developed portions of the color-forming layer.

11. The composite of claim 1, wherein said leuco dye is selected from the group consisting of fluorans, phthalides, amino-triarylmethanes, aminoxanthenes, aminothioxanthenes, amino-9, 10-dihydro-acridines, aminophenoxazines, aminophenothiazines, aminodihydro-phenazines, aminodiphenylmethanes, aminohydrocinnamic acids and corresponding esters, 2(p-hydroxyphenyl)-4,5-diphenylimidazoles, indanones, leuco indamines, hydrozines, leuco indigoid dyes, amino-2,3-dihydroanthraquinones, tetrahalo-p,p'-biphenols, 2(p-hydroxyphenyl)-4,5-diphenylimidazoles, phenethylanilines, phthalocyanine precursors, and mixtures thereof.

12. The composite of claim 11, wherein said leuco dye is a fluoran.

13. The composite of claim 11, wherein said color-forming layer further comprises an activator.

14. The composite of claim 11, further comprising an electromagnetic radiation absorber in thermal contact with the leuco dye.

15. The composite of claim 14, wherein said electromagnetic radiation absorber is an infrared absorber.

16. The composite of claim 15, wherein said infrared absorber is configured for development using electromagnetic energy having a wavelength from 600 nm to about 1200 nm.

17. The composite of claim 11, wherein the leuco dye is a fluoran and the leuco dye layer further comprises an infrared absorber.

18. The composite of claim 1, wherein said substrate comprises a member selected from the group consisting of polymer, paper, metal, glass, and combinations thereof.

19. The composite of claim 18, wherein said substrate is in the form of an optical disk.

20. The composite of claim 1, wherein said fixed background color is produced with a composition including a background colorant.

21. The composite of claim 20, wherein said background colorant is a pigment.

22. The composite of claim 1, wherein the background layer further comprises an ultraviolet curable resin.

23. A method of forming color images on a substrate, comprising:

a) applying a background color layer having a fixed background color onto a substrate;

b) applying a color-forming layer onto the substrate, said color-forming layer including a leuco dye and being spatially configured with respect to the background color layer to produce a perceived image that is the result of the fixed background color and developed portions of the color forming layer and wherein at least one of the color-forming layer and the background layer is applied in a filter pattern; and c) applying electromagnetic radiation to at least a portion of the color-forming layer sufficient to cause development of the leuco dye within the portion, thereby forming a developed color.

24. The method of claim 23, wherein the color-forming layer is sufficiently thin to allow a portion of the fixed background color to be visible through the developed portion of the color-forming layer.

25. The method of claim 24, wherein the color-forming layer is applied in a filter pattern.

26. The method of claim 25, wherein the color-forming layer is applied in a halftone pattern.

27. The method of claim 23, wherein the filter pattern is selected from the group consisting of halftone, stochastic, checkered, moiré, spiral, and combinations thereof.

28. The method of claim 23, wherein said leuco dye is selected from the group consisting of fluorans, phthalides, amino-triarylmethanes, aminoxanthenes, aminothioxanthenes, amino-9, 10-dihydro-acridines, aminophenoxazines, aminophenothiazines, aminodihydro-phenazines, aminodiphenylmethanes, aminohydrocinnamic acids and corresponding esters, 2(p-hydroxyphenyl)-4,5-diphenylimidazoles, indanones, leuco indamines, hydrozines, leuco indigoid dyes, amino-2,3-dihydroanthraquinones, tetrahalo-p,p'-biphenols, 2(p-hydroxyphenyl)-4,5-diphenylimidazoles, phenethylanilines, phthalocyanine precursors, and mixtures thereof.

29. The method of claim 23, wherein the leuco dye is a fluoran and the background color comprises a pigment.

30. The method of claim 23, further comprising an infrared absorber admixed with or in thermal contact with the leuco dye.

31. The method of claim 30, wherein the electromagnetic radiation is infrared radiation.

32. The method of claim 31, wherein said infrared radiation has a heat flux from about 0.05 to 5.0 J/cm2 and is applied for from about 10 microseconds to about 100 microseconds.

33. The method of claim 23, wherein one or both of the background color layer and color-forming layer is applied using a technique selected from the group consisting of screen-printing, spin coating, roller coating, sputtering, spray coating, thermal spray deposition, offset, gravure, ink-jet, electrostatic, laser, liquid embossing, and liquid electrophotography.

34. The method of claim 23, wherein the step of applying electromagnetic radiation occurs such that the color-forming composition is at least partially developed, and such that the color-forming layer and is not decomposed during development.

35. A multi-layered color system, comprising:

a) a composite colored material including:

i) a substrate;

ii) a background color layer having a fixed background color applied to the substrate; and iii) a color-forming layer applied to the substrate, said color-forming layer including a leuco dye and at least of said background color layer and color-forming layers being applied in a filter pattern; and b) an electromagnetic radiation source, configured to apply electromagnetic radiation to at least a portion of the color-forming layer sufficient to cause development of the leuco dye within the portion, thereby forming a developed color.

36. The method of claim 35, wherein the filter pattern is selected from the group consisting of halftone, stochastic, checkered, moiré, spiral, and combinations thereof.

37. The system of claim 35, wherein said filter pattern is a halftone pattern.

38. The system of claim 35, wherein said leuco dye is selected from the group consisting of fluorans, phthalides, amino-triarylmethanes, aminoxanthenes, aminothioxanthenes, amino-9,10-dihydro-acridines, aminophenoxazines, aminophenothiazines, aminodihydro-phenazines, aminodiphenylmethanes, aminohydrocinnamic acids and corresponding esters, 2(p-hydroxyphenyl)-4,5-diphenylimidazoles, indanones, leuco indamines, hydrozines, leuco indigoid dyes, amino-2,3-dihydroanthraquinones, tetrahalo-p,p'-biphenols, 2(p-hydroxyphenyl)-4,5-diphenylimidazoles, phenethylanilines, phthalocyanine precursors, and mixtures thereof.

39. The system of claim 36, further comprising an electromagnetic radiation absorber in thermal contact with the leuco dye.

40. The system of claim 39, wherein said electromagnetic radiation source is an infrared laser having a frequency of from about 600 nm to about 1200 nm.

41. The system of claim 35, wherein the substrate is an optical disk.

42. The system of claim 36, further comprising a protective layer applied to the color-forming layer.

* * * * *

UNITED STATES PATENT AND TRADEMARK OFFICE

CERTIFICATE OF CORRECTION

PATENT NO. : 7,148,182 B2
APPLICATION NO. : 10/833789
DATED : December 12, 2006
INVENTOR(S) : Field et al.

It is certified that error appears in the above-identified patent and that said Letters Patent is hereby corrected as shown below:

In the Claims

Col. 16 (line 12) delete “and”.

Signed and Sealed this

Sixteenth Day of October, 2007

JON W. DUDAS
*Director of the United States Patent and Trademark Office*